United States Patent [19]

Sueishi et al.

[11] 4,121,554

[45] Oct. 24, 1978

[54] AIR-FUEL RATIO FEEDBACK CONTROL SYSTEM

[75] Inventors: Motoharu Sueishi; Katsushi Kato; Yoshiaki Sato, all of Kariya, Japan

[73] Assignee: Nippondenso Co., Ltd., Kariya, Japan

[21] Appl. No.: 812,955

[22] Filed: Jul. 5, 1977

[30] Foreign Application Priority Data

Jul. 2, 1976 [JP] Japan ..... 51/79095

[51] Int. Cl.[2] ..... F02B 33/00

[52] U.S. Cl. ..... 123/119 EC; 60/276; 60/285; 123/32 EE; 123/32 EH

[58] Field of Search ..... 123/119 EC, 32 EE, 32 EH, 123/32 EL, 124 B, 32 EA, 102, 119, 97; 60/276, 285

[56] References Cited

U.S. PATENT DOCUMENTS

| | | | |
|---|---|---|---|
| 3,570,460 | 3/1971 | Rabus | 123/102 |
| 3,923,016 | 12/1975 | Hoshi | 123/32 EE |
| 3,926,154 | 12/1975 | Williams | 60/276 |
| 3,998,189 | 12/1976 | Aoki | 60/276 |
| 4,003,350 | 1/1977 | Eisele et al. | 60/276 |
| 4,019,470 | 4/1977 | Asano | 123/32 EE |
| 4,030,462 | 6/1977 | Sasayama et al. | 60/285 |
| 4,031,866 | 6/1977 | Asano | 60/276 |
| 4,040,394 | 8/1977 | Wahl et al. | 123/119 EC |
| 4,073,269 | 2/1978 | Herth et al. | 60/276 |
| 4,077,364 | 3/1978 | Aoki | 123/32 EH |

*Primary Examiner*—Charles J. Myhre
*Assistant Examiner*—R. A. Nelli
*Attorney, Agent, or Firm*—Edwin E. Greigg

[57] ABSTRACT

The combination of a fuel supply system for an internal combustion engine, an exhaust gas oxygen concentration sensor and a feedback control system including an integration circuit connected to the fuel supply system and a correction control circuit connected to the exhaust gas oxygen concentration sensor and the integration circuit. The combination controls the air-fuel mixture to be supplied to an engine in accordance with an integration output signal, which in turn is generated from the output signal generated by the exhaust gas oxygen concentration sensor. The correction control circuit serves to disconnect the exhaust gas oxygen concentration sensor from the integration circuit when a predetermined operating condition of the engine is reached, thereby holding the output from the integration circuit constant.

4 Claims, 8 Drawing Figures

AIR-FUEL RATIO FEEDBACK CONTROL SYSTEM

BACKGROUND OF THE INVENTION

Detailed Description of the Invention

This invention relates to an air-fuel ratio feedback control system for controlling the air-fuel ratio of an air-fuel mixture to be supplied to an internal combustion engine by sensing and feeding back the oxygen concentration of engine exhaust gases which is representative of the air-fuel ratio of the supplied air-fuel mixture.

In order to purify exhaust gases from an internal combustion engine, it has heretofore been proposed to sense and feed back the oxygen concentration of exhaust gases in order to control the air-fuel ratio of an air-fuel mixture in accordance with the oxygen concentration so that the ratio is equal to, for example, a constant theoretical air-fuel ratio. This method of feedback control has proved to be advantageous in that the air-fuel ratio remains constant even though major changes occur in outside environments such as atmospheric pressure variations, intake air temperature changes and so forth. Further, it has been verified that with the integration of inverted oxygen concentration measurements in a feedback control loop, control speed is improved. However, if this feedback control is made operative during all engine operating conditions, a problem arises that desired power demands are not met at acceleration and full loads, since the air-fuel ratio is held at a constant level. Further, this feedback control method has the disadvantage that it fails to provide lean fuel mixtures during deceleration or no loads.

OBJECT OF THE INVENTION

It is with the above in view that the present invention came about, and its object is to provide a system which operates, during certain engine operating conditions such as deceleration or increasing power demands requiring no air-fuel ratio feedback control, to hold the integrated value of a measurement signal from the air-fuel ratio sensor at the the value existing just before the feedback control was disabled, irrespective of changes in the measurement signal, thereby providing desired characteristics, and also to permit extremely rapid return to the normal feedback control operation.

DESCRIPTION OF THE PREFERRED EMBODIMENT

Figure 1:
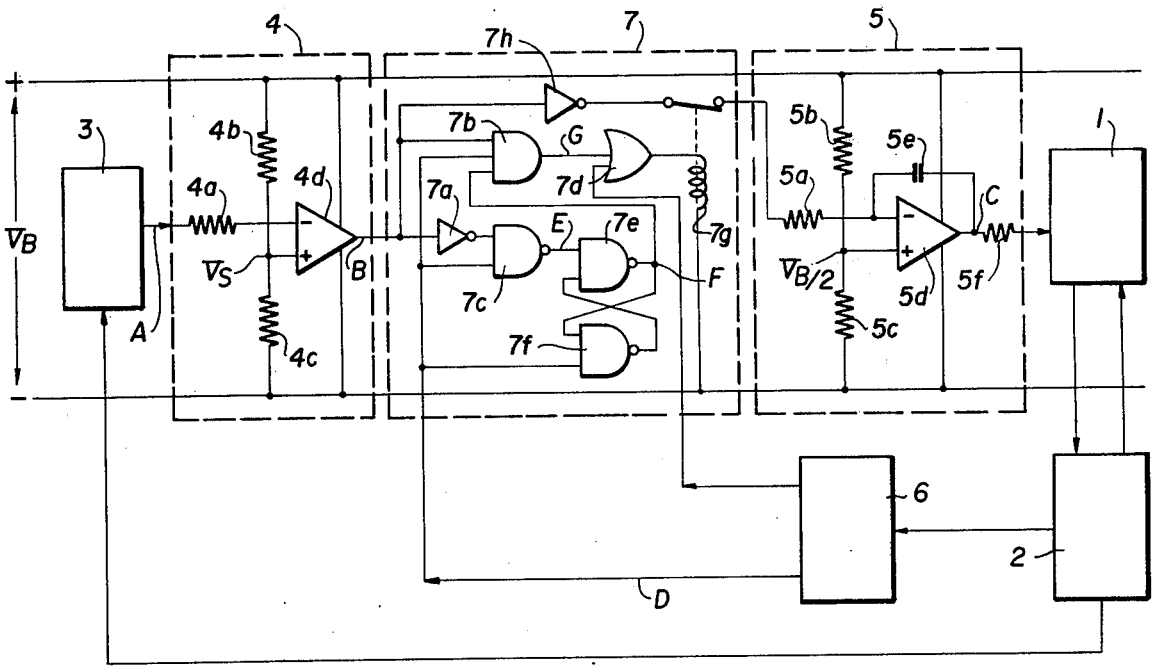
FIG. 1 is a circuit diagram partially in block form, of a preferred embodiment of the present invention.

The invention will be described below with regard to an embodiment thereof in conjunction with the accompanying drawings. Referring to FIG. 1, an air-fuel mixture supplying device 1 comprises a well known device for supplying an air-fuel mixture to the intake portion of an internal combustion engine 2, for example, a carburetor or electronically controlled fuel injection system, in which the air-fuel ratio characteristics have been preset according to engine operating conditions. An air-fuel ratio sensor 3 is located at the exhaust portion of the engine 2, which sensor is of the known type capable of providing an inverted signal having a step characteristic and representative of the oxygen concentration of the exhaust gases. A feedback system for feeding back a measurement signal from the air-fuel ratio sensor 3 at the exhaust portion to the intake portion of the engine 2 includes a discrimination circuit 4 for comparing the measurement signal with a predetermined value, an integration circuit 5 for integrating the output of the discrimination circuit 4 to provide a signal corresponding to the integral of the output, an engine operating condition detector 6 for detecting the occurrence of certain predetermined engine operating conditions, and a correction control circuit 7 responsive to the engine operating condition detector 6 for controlling the application of the discrimination circuit 4 output to the integration circuit 5. The output of the integration circuit 5 is supplied to the air-fuel mixture supplying device 1 which in turn operates to correct the air-fuel ratio of an air-fuel mixture supplied to the engine in accordance with the integral from the integration circuit 5. Known methods of correcting the air-fuel ratio comprise addition of the amount of fuel or air based on the integral.

The discrimination circuit 4 comprises resistors 4*a*, 4*b*, 4*c*, and a comparator 4*d* having an inverting input (−) connected to the output of the air-fuel ratio sensor 3 and a non-inverting input (+) connected to receive a predetermined voltage Vs. This voltage Vs corresponds to a theoretical air-fuel ratio. When the output of the air-fuel ratio sensor 3 is at a low level which is indicative of an air-fuel ratio greater than the theoretical air-fuel ratio, the comparator 4*d* generates a high level output. On the other hand, when the sensed air-fuel ratio from the air-fuel ratio sensor 3 is at a high level, the comparator 4*d* generates a low level output.

The integration circuit 5 comprises resistors 5*a*, 5*b*, 5*c*, 5*f*, an operational amplifier 5*d* and a capacitor 5*e*, and the operational amplifier 5*d* has a non-inverting input (+) connected to a constant voltage $V_B/2$ and an inverting input (−) connected to the output of the discrimination circuit 4 through the correction control circuit 7.

The correction control circuit 7 comprises inverters 7*a*, 7*b*, an AND gate 7*b*, NAND gates 7*c*, 7*e*, 7*f*, an OR gate 7*d*, and a relay 7*g*. The relay 7*g*, when deenergized, closes, permitting the output of the discrimination circuit 4 to be applied to the integration circuit 5. When energized, the relay opens the circuit between the discriminator 4 and the integration circuit 5, preventing application of the discriminator output to the integration circuit 5.

Figure 2:
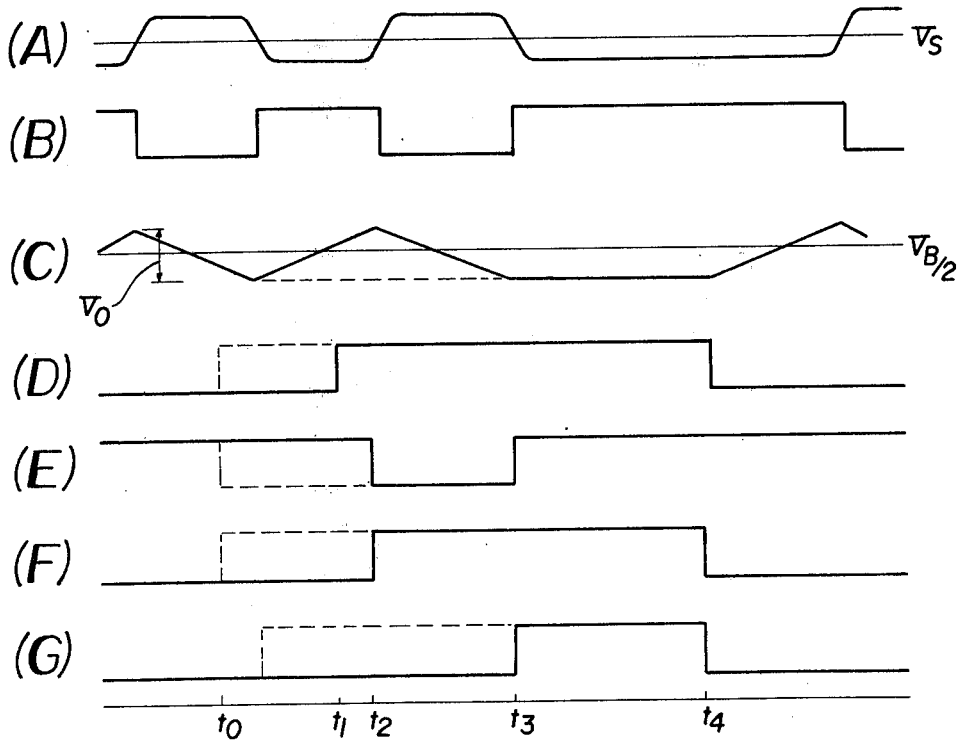
FIGS. 2(A)-(G) are waveform diagrams of various signals appearing in the circuit of FIG. 1, being useful in explaining the operation of the present feedback control system.

The operation of the present system as described above will be described with reference to FIG. 2. The engine operating condition detector 6. The engine operating condition detector 6 is adapted to generate a high level voltage output when the throttle valve of the engine 2 is fully closed. The air-fuel mixture supplying device 1 is capable of supplying the air-fuel mixture having an air-fuel ratio greater than the theoretical air-fuel ratio when the throttle valve is fully closed. The air-fuel mixture supplying device 1 is adjusted so that the air-fuel ratio of the supplied air-fuel mixture decreases with an increase of the integral from the integration circuit 5 and increases with a decrease of the integrated signal. During normal engine operating conditions and when the throttle valve is not fully closed, the air-fuel ratio sensor 3 produces at point A an inverted signal corresponding to the air-fuel ratio, as shown in FIG. 2(A). In this condition, the discriminator circuit 4 produces at point B a discriminated signal of rectangular shape, FIG. 2(B), which is an inverted signal to the signal at point A. This discriminated signal is supplied to the integration circuit 5 through the relay *7g* which is in the closed condition. Hence, the integration circuit 5 produces at point C an output signal varying with the measurement signal from the air-fuel ratio sensor 3, which output signal is the integral of the discriminator 4 output, FIG. 2(C). The air-fuel mixture supplying device 1 responds to this integral by correcting the air-fuel ratio of an air-fuel mixture supplied to the engine 2 so that the air-fuel ratio is substantially equal to the theoretical air-fuel ratio. The integral value varies within upper and lower limits which are different by $V_o$, as shown in FIG. 2(C).

When the engine throttle valve becomes fully closed at time $t_1$ (FIG. 2), during this feedback control being operative, the engine operating condition detector 6 produces at point D a high level voltage output, as seen in FIG. 2(D), which voltage signal is applied to the correction control circuit 7. Since the output of the discrimination circuit 4 is inverted by the inverter *7a*, at time $t_2$ the NAND gate *7c* produces a low level voltage output at point E, as seen in FIG. 2(E). A flip-flop consisting of NAND gates *7e, 7f* is set by this low level voltage signal to produce a high level voltage signal at point F, as shown in FIG. 2(F). The AND gate *7b* has applied thereto as inputs the output of the discriminator circuit 4, a high level voltage signal from the engine operating condition detector 6 indicative of the throttle valve being fully closed, and the high level voltage signal from the flip-flop and produces at point G, FIG. 2(G), a high level voltage signal at time $t_3$ when the discriminator output increases to the high voltage level. Since the discriminator output is coupled to the integrator circuit 5 during the time $t_1$ when the throttle valve is fully closed to $t_3$, the output of the integration circuit 5 varies within the upper and lower limits which are different by $V_o$, as shown in FIG. 2(C). However, when the AND gate *7b* output rises to a high voltage level at $t_3$, the relay *7g* becomes energized, opening its contacts so that the integrator input is disconnected from the comparator output. As a result, the integrator circuit 5 holds its output at the value which existed when the input was shut off. Since the integrator circuit 5 holds its output at time $t_3$ when the output of the air-fuel ratio sensor 3 decreases from its high to low level, the value at which the integrator output is held is substantially equal to the lower limit which existed prior to the throttle valve being fully closed, which means that there is a need to increase the air-fuel mixture. Although the air-fuel mixture supplying device 1 is adjusted so as to supply an air-fuel mixture having an air-fuel ratio larger than the theoretical air-fuel ratio when the throttle valve is fully closed, the integrator output which has been held at a constant value will insure that the engine is supplied with an air-fuel mixture of an air-fuel ratio larger than the theoretical air-fuel ratio, since the integrator output acts to correct the air-fuel ratio. The engine operating conditions in which the throttle valve is fully closed include deceleration or no load operation such as idling and it would be desirable to supply a lean mixture while the throttle valve is fully closed. When the throttle valve becomes open at time $t_4$ after $t_3$, the air-fuel ratio feedback control system restarts correcting the air-fuel ratio in accordance with the integral corresponding to the output of the air-fuel ratio sensor in the same manner as before the time $t_1$ when the throttle valve became fully closed. Return to the theoretical air-fuel ratio is accomplished rapidly since the integral value at which the integrator output was held is very close to the theoretical ratio.

In the above-described embodiment, if the throttle valve becomes fully closed at time $t_o$ prior to $t_1$, the voltages at points A to G in FIG. 1 change as indicated by broken lines in FIG. 2(A) to (G). As will be seen in FIG. 2(C), in this case also, the integrator output is held at the lower limit in the same manner as described above. In case where an electronically controlled fuel injection system is employed as the air-fuel mixture supplying device 1, the fuel supply to the engine is cut off during deceleration. In this condition, the engine operating condition detector 6 applies to the OR gate *7d* of the correction control circuit 7 a high level voltage signal indicative of fuel cutoff, whereupon the integrator output is held at a value within the upper and lower limits $v_o$. Needless to say, when the high level voltage signal ceases to exist, the integrator output is held at the lower limit.

While in the embodiment the integrator output is held only during the time when the throttle valve is fully closed, it would be possible to design the system so that the integrator output is held at certain other operating conditions such as the throttle valve being fully open, in which case the integrator output is held at the upper limit insuring that the air-fuel mixture having an air-fuel ratio smaller than the theoretical ratio is supplied to the engine.

As has been described above, the present invention has the advantages that the air-fuel ratio of an air-fuel mixture is corrected in accordance with the integral of the oxygen concentration of exhaust gases and the integrator output is held at limit values depending upon the engine operating conditions, thereby permitting air-fuel ratio feedback control depending upon the engine operating conditions. Even if the air-fuel mixture supplying device has its air-fuel ratio characteristics deviated from the correct values, the present feedback control system insures that a desired air-fuel ratio control is effected.

With regard to the details of the blocks shown in FIG. 1 reference can be made to the U.S. Pat. No. 3,745,768 in which the mixture supply device 1 and the air-fuel ratio sensor 3 are disclosed and to the U.S. Pat. No. 3,570,460 in which the operating condition detector 6 is disclosed.

What is claimed is:

1. In combination with a fuel supply system for an internal combustion engine, said fuel supply system controlling the amount of air-fuel mixture to be supplied to an engine in accordance with preset air-fuel ratio characteristic of the fuel supply system, and an air-fuel ratio sensing means for sensing the oxygen concentration of the exhaust gas of an engine and generating an output signal which is of inverted polarity and corresponds to the air-fuel ratio of the air-fuel mixture supplied by the fuel supply system, the improvement comprising an air-fuel ratio feedback control system including:

(a) an integrating circuit connected to the fuel supply system; and (b) a correction control circuit connected to the air-fuel ratio sensing means and to the integrating circuit, whereby the integrating circuit integrates the output of the air-fuel ratio sensing means and applies an integrated output signal to the fuel supply system in order to correct the air-fuel ratio of the supplied air-fuel mixture in accordance with the integrated output signal, said correction control circuit including means for disconnecting the air-fuel ratio sensing means from the integrating circuit in response to certain predetermined operating conditions of an engine, thereby holding the output from the integrator circuit constant.

2. The combination as defined in claim 1, wherein the air-fuel ratio feedback control system further comprises:

(c) comparator circuit means connected to the air-fuel ratio sensing means and to the correction control circuit, for comparing the output signal from the air-fuel ratio sensing means to a predetermined value corresponding to a theoretical air-fuel ratio, and generating an output signal which is applied to the correction control circuit and consequently to the integrating circuit as the input signal to be integrated, said output signal of the comparator circuit means having a value which depends on whether the output signal from the air-fuel ratio sensing means is higher or lower than the predetermined value.

3. The combination as defined in claim 1, wherein the air-fuel ratio feedback control system further comprises:

(c) engine operating condition detector means connected to the correction control circuit for determining the occurrance of certain predetermined operating conditions of an engine and actuating the disconnecting means of the correction control circuit to thereby disconnect the air-fuel ratio sensing means from the integrating circuit whenever said certain predetermined operating conditions occur.

4. The combination as defined in claim 1, wherein the air-fuel ratio feedback control system further comprises:

(c) comparator circuit means connected to the air-fuel ratio sensing circuit, for comparing the output signal from the air-fuel ratio sensing means to a predetermined value corresponding to a theoretical air-fuel ratio and generating an output signal which is applied to the correction control circuit and consequently to the integrating circuit as the input signal to be integrated, said output signal of the comparator circuit means having a value which depends on whether the output signal from the air-fuel ratio sensing means is higher or lower than the predetermined value; and (d) engine operating condition detector means connected to the correction control circuit for determining the occurance of certain predetermined operating conditions of an engine and actuating the disconnecting means of the correction control circuit to thereby disconnect the comparator circuit means and thereby the air-fuel ratio sensing means from the integrating circuit whenever said certain predetermined operating conditions occur.

* * * * *